US010267603B2

(12) United States Patent
Marshall et al.

(10) Patent No.: US 10,267,603 B2
(45) Date of Patent: Apr. 23, 2019

(54) OFF-AXIS ANNULAR PRECISION INITIATION CHARGE

(71) Applicant: Southwest Research Institute, San Antonio, TX (US)

(72) Inventors: Andrew J. Marshall, San Antonio, TX (US); Thad C. Smith, College Station, TX (US); Carl E. Weiss, San Antonio, TX (US); Joseph M. Herring, San Antonio, TX (US)

(73) Assignee: SOUTHWEST RESEARCH INSTITUTE, San Antonio, TX (US)

( * ) Notice: Subject to any disclaimer, the term of this patent is extended or adjusted under 35 U.S.C. 154(b) by 0 days.

(21) Appl. No.: 15/659,422

(22) Filed: Jul. 25, 2017

(65) Prior Publication Data

US 2019/0033044 A1 Jan. 31, 2019

(51) Int. Cl.
*F42B 1/028* (2006.01)
*F42D 1/08* (2006.01)

(52) U.S. Cl.
CPC ..... *F42B 1/028* (2013.01); *F42D 1/08* (2013.01)

(58) Field of Classification Search
CPC ..... F42B 1/028; F42D 1/08
USPC ..... 102/306
See application file for complete search history.

(56) References Cited

U.S. PATENT DOCUMENTS 5,551,346 A * 9/1996 Walters ..... F42B 1/02 102/306
6,386,109 B1 * 5/2002 Brooks ..... E21B 43/117 102/306
7,861,636 B1 * 1/2011 Hoffman ..... F41A 21/34 89/14.2
9,261,319 B1 * 2/2016 Palu ..... F41A 21/34
9,599,421 B1 * 3/2017 Dean ..... F41A 21/30
2010/0229713 A1 * 9/2010 Heath ..... F41A 21/34 89/14.2
2017/0038172 A1 * 2/2017 Palu ..... F41A 21/30
2017/0067711 A1 * 3/2017 Slack ..... F41A 21/30

* cited by examiner

*Primary Examiner* — Samir Abdosh
(74) *Attorney, Agent, or Firm* — Grossman, Tucker et al.

(57) ABSTRACT

One embodiment provides an apparatus. The apparatus includes a substrate body that includes a top end, an opposing bottom end and a curved outer surface positioned there between, and a clear sight bore aperture centered at a longitudinal axis of the substrate body. The apparatus further includes a trunk line aperture defined in the outer surface of the substrate body. The trunk line aperture has a first end positioned at a top end of the substrate body, off-center from the longitudinal axis. The first end of the trunk line aperture is configured to couple to a detonator. The apparatus further includes a plurality of helical track apertures defined in the outer surface of the substrate body. A respective first end of each helical track aperture is coupled to the trunk line aperture. The apparatus further includes a plurality of termination apertures defined in the outer surface of the substrate body adjacent the bottom end of the substrate body. One termination aperture is coupled to the trunk line aperture at a second end of the trunk line aperture. The second end is opposing the first end and each remaining termination aperture is coupled to a respective helical track aperture. The trunk line aperture, the plurality of helical track apertures and the plurality of termination apertures are configured to contain an explosive material.

19 Claims, 11 Drawing Sheets

OFF-AXIS ANNULAR PRECISION INITIATION CHARGE

GOVERNMENT SUPPORT CLAUSE

This invention was made with United States Government support under Contract No. H92222-15-D-0011 TO 002 funded by USSOCOM. The Government has certain rights in this invention.

FIELD

The present disclosure relates to a precision initiation charge, in particular to, an off-axis annular precision initiation charge.

BACKGROUND

Explosive ordnance technicians may utilize a precision explosive tool to disable a target device. In use, the precision explosive tool may be aimed at a target location on the target device using an alignment tool, for example, a laser, to align the explosive tool. Once the explosive tool is aligned, the laser may then be removed, the explosive ordinance technician may leave the area and the explosives may be detonated. Removal of the alignment device can interfere with the aim of the precision explosive tool and without the alignment device, the aim cannot be confirmed.

SUMMARY

In one example, there is provided an apparatus. The apparatus includes a substrate body that includes a top end, an opposing bottom end and a curved outer surface positioned there between, and a clear sight bore aperture centered at a longitudinal axis of the substrate body. The apparatus further includes a trunk line aperture defined in the outer surface of the substrate body. The trunk line aperture has a first end positioned at a top end of the substrate body, off-center from the longitudinal axis. The first end of the trunk line aperture is configured to couple to a detonator. The apparatus further includes a plurality of helical track apertures defined in the outer surface of the substrate body. A respective first end of each helical track aperture is coupled to the trunk line aperture. The apparatus further includes a plurality of termination apertures defined in the outer surface of the substrate body adjacent the bottom end of the substrate body. One termination aperture is coupled to the trunk line aperture at a second end of the trunk line aperture. The second end is opposing the first end and each remaining termination aperture is coupled to a respective helical track aperture. The trunk line aperture, the plurality of helical track apertures and the plurality of termination apertures are configured to contain an explosive material.

In another example, there is provided an explosive system. The explosive system includes a main explosive charge; and an off-axis annular precision initiation charge (APIC) assembly coupled to the main explosive charge. The off-axis APIC assembly includes a substrate body. The substrate body includes a top end, an opposing bottom end and a curved outer surface positioned there between. The off-axis APIC assembly further includes a clear sight bore aperture centered at a longitudinal axis of the substrate body. The off-axis APIC assembly further includes a trunk line having a first end positioned at the top end of the substrate body, off-center from the longitudinal axis. The first end of the trunk line is configured to couple to a detonator. The off-axis APIC assembly further includes a plurality of helical tracks. A respective first end of each helical track is coupled to the trunk line. The off-axis APIC assembly further includes a plurality of terminations positioned adjacent the bottom end of the substrate body. One termination is coupled to the trunk line at a second end of the trunk line, the second end opposing the first end and each remaining termination is coupled to a respective helical track. The off-axis APIC assembly further includes an explosive booster coupled to the plurality of terminations and to the substrate body at the bottom end of the substrate body. The trunk line, the plurality of helical tracks and the plurality of terminations contain an explosive material.

FIGURES

Features and advantages of the claimed subject matter will be apparent from the following detailed description of embodiments consistent therewith, which description should be considered with reference to the accompanying drawings, wherein:

Figure 1A:
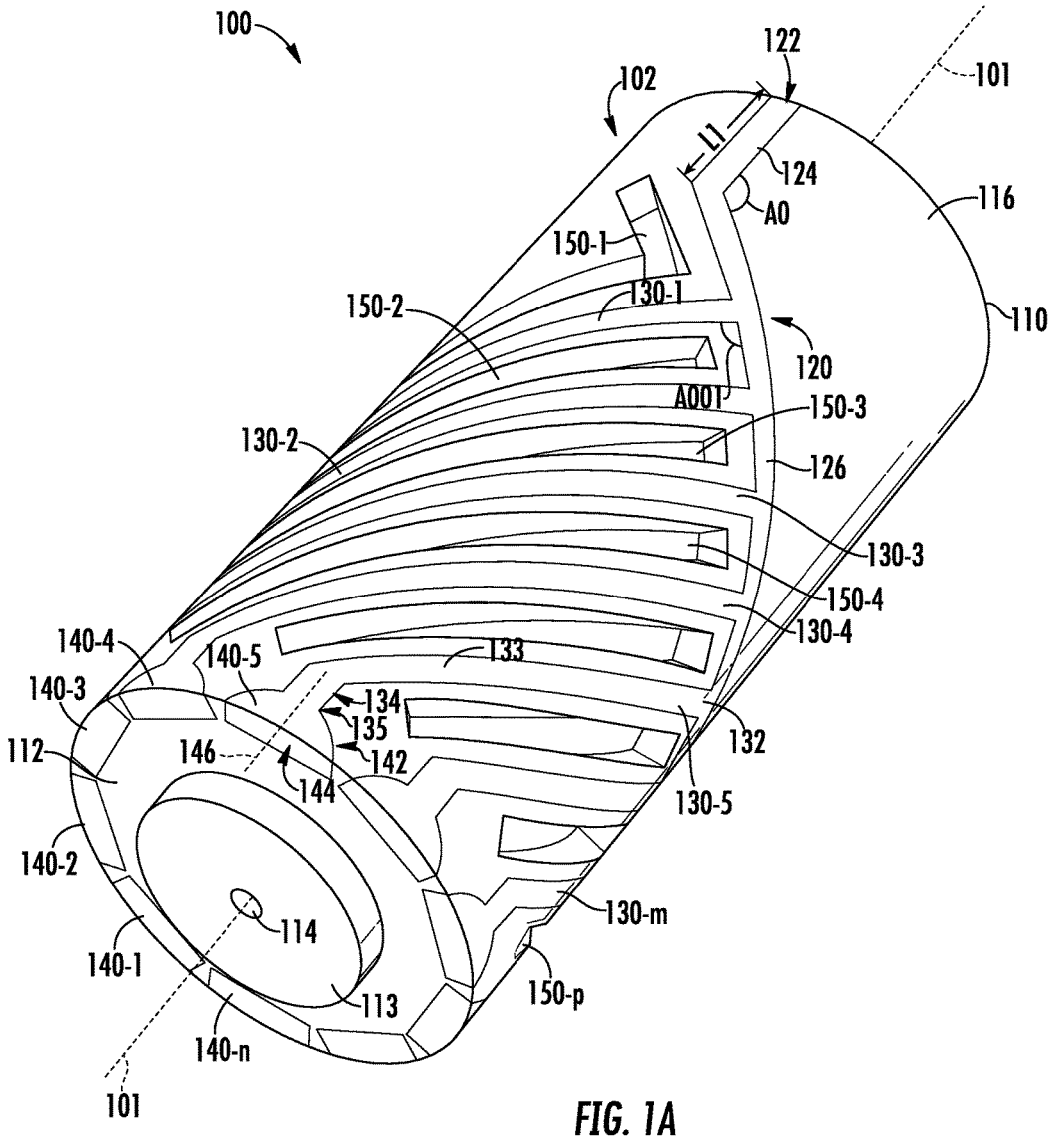
FIGS. 1A through 1D illustrate an example off-axis annular precision initiation charge (APIC), consistent with several embodiments of the present disclosure.

Although the following Detailed Description will proceed with reference being made to illustrative embodiments, many alternatives, modifications, and variations thereof will be apparent to those skilled in the art.

DETAILED DESCRIPTION

A precision explosive tool includes a main explosive charge and may include an initiation charge. The main explosive charge may be initiated directly with a detonator attached to the main explosive charge or with a precision initiation charge configured to provide a ring light to the main explosive charge. The detonator may be attached to a center point of the main explosive charge or to a center point of the precision initiation charge. The detonator attached to the center point of the main explosive charge is configured to provide a uniform, symmetrical detonation wave in the main explosive charge. The detonator attached to the center point of the precision initiation charge is configured to trigger the initiation charge to generate, and then provide, a ring light to the main explosive charge. As used herein, "ring light" corresponds to a ring-shaped (i.e., annular shaped) explosive wave front over a strike face (i.e., surface of the initiation charge that couples to the main explosive charge). The ring light is configured to provide a uniform, symmetrical detonation wave in the main explosive charge.

Typically, a detonator is opaque to at least laser light. A detonator positioned off-center, i.e., off axis, may not provide a uniform symmetric wave. A nonuniform and/or asymmetric detonation wave in the main explosive charge may interfere with operation of the main explosive charge.

Generally, this disclosure relates to an off-axis annular precision initiation charge (APIC) that may be included in an explosive system. An APIC assembly is configured to couple to a detonator positioned off-axis at a first end and to produce a ring light at an opposing second end. The APIC assembly is configured to include a continuous bore aperture configured to allow, for example, a laser light beam from a laser source to traverse the APIC assembly. The continuous bore aperture may be centered at a longitudinal center line of the APIC assembly. The continuous bore aperture is configured to facilitate aiming the explosive system at a target device using the laser light then removing the laser source without disturbing the aim of the explosive tool.

The explosive system may correspond to an explosive tool or a munitions system. The explosive system may further include a main explosive charge coupled to the off-axis APIC assembly. The main charge is configured to include a corresponding main charge bore aperture configured to align with the APIC assembly continuous bore aperture when the main explosive charge is coupled to the APIC assembly. The main charge may include, but is not limited to, a shaped charge or an explosively formed projectile (e.g., an explosively formed penetrator). The munitions system may further include an aiming system.

The APIC assembly may include an APIC body, an explosive booster, a tamper and an end cap. The APIC body includes a substrate body and an explosive material. The substrate body includes a top end, an opposing bottom end generally parallel to the top end and a curved outer surface generally perpendicular to the top end and the bottom end and positioned there between. In one example, the substrate body may have a generally cylindrical shape. As used herein, "top" and "bottom" correspond to a first end of the substrate body and an opposing second end of the substrate body and do not necessarily indicate relative positions in space. The substrate body may define a clear sight bore aperture, centered at a longitudinal axis ("centerline") of the substrate body.

A trunk line aperture, a plurality of helical track apertures and a plurality of termination apertures may be defined in the curved outer surface of the substrate body. The trunk line aperture, the plurality of helical track apertures and the plurality of termination apertures are configured to receive and thus contain an explosive material. As used herein, "trunk line" corresponds to the explosive material contained in the trunk line aperture. As used herein, "helical track" corresponds to the explosive material contained in a helical track aperture. As used herein, "termination" corresponds to the explosive material contained in a termination aperture. Thus, a trunk line, a helical track and a termination may each have a respective geometry defined by the respective aperture.

The trunk line, the plurality of helical tracks and the plurality of terminations are configured to provide a plurality of continuous paths of explosive material between a detonator positioned off center at the top end of the APIC body (and substrate body) and a plurality of termination bottom surfaces positioned at the bottom end of the APIC body (and substrate body). The detonator may be coupled to a first end of the trunk line. The first end of the trunk line may be positioned at a top end of the substrate body. Respective travel times of respective explosive wave fronts along the plurality of continuous paths between the detonator (and, thus, the trunk line first end) and each respective termination bottom surface are configured to provide a ring light to the main explosive charge. A target range of travel times for the plurality of paths between the trunk line first end and the plurality termination bottom surfaces for a plurality of explosive wave fronts may be determined based, at least in part, on an application of the explosive system. A range of travel times corresponds to a time interval between a shortest travel time and a longest travel time associated with the plurality of paths. In one example, the target range of travel times may be less than or equal to 100 nanoseconds. In another example, the target range of travel times may be less than or equal to 200 nanoseconds.

The off-axis APIC assembly may be coupled to a main explosive charge at the bottom end of the APIC body in an explosive system. The main explosive charge may define an explosive charge bore aperture configured to align with the off-axis APIC assembly continuous bore aperture. The main explosive charge may include an explosive portion and a liner. The explosive portion may define an explosive bore aperture and the liner may define a liner bore aperture aligned with the explosive bore aperture. The explosive bore aperture and liner bore aperture may thus correspond to the explosive charge bore aperture.

In operation, a laser source may be aimed at a target region or target point on a target device. The continuous bore aperture and explosive charge bore aperture are configured to provide an unobstructed line of sight through the explosive system. Thus, the explosive system may be positioned between the laser source and the target device and a corresponding laser light (i.e., laser beam) may pass through the explosive system, unobstructed. The explosive system may be positioned anywhere along the laser beam between the laser source and the target device. In other words, the laser beam may correspond to a "light rail". After aiming, the laser beam may then travel through the explosive system from the top end of the APIC assembly through the main explosive charge and on to the target. The laser source may then be removed without touching the explosive tool. Thus, disturbing the aim of the explosive tool may be avoided. Explosive ordnance technicians may leave the area and the detonator may initiate the off-axis APIC that may then initiate the main explosive charge. Thus, an aiming device, e.g., the laser source, may be removed without affecting aim of the explosive tool and off-axis detonation may provide a uniform, symmetrical detonation wave in the main explosive charge.

Thus, the off-axis APIC assembly is configured to provide a uniform ring light to a main explosive charge with an off-center detonator initiating the APIC. The trunk line, plurality of helical tracks and plurality of terminations facilitate positioning the detonator off center while still providing a uniform ring light to the main explosive charge. The clear sight bore aperture of the substrate body, continuous bore aperture of the APIC assembly and explosive charge bore aperture of the main explosive charge may then be positioned (i.e., centered) at a centerline of the APIC assembly (and explosive system), thus facilitating aiming the associated explosive system using, for example, the laser light source positioned behind the explosive system. The laser source may then be removed without disturbing the aim.

Figure 1B:
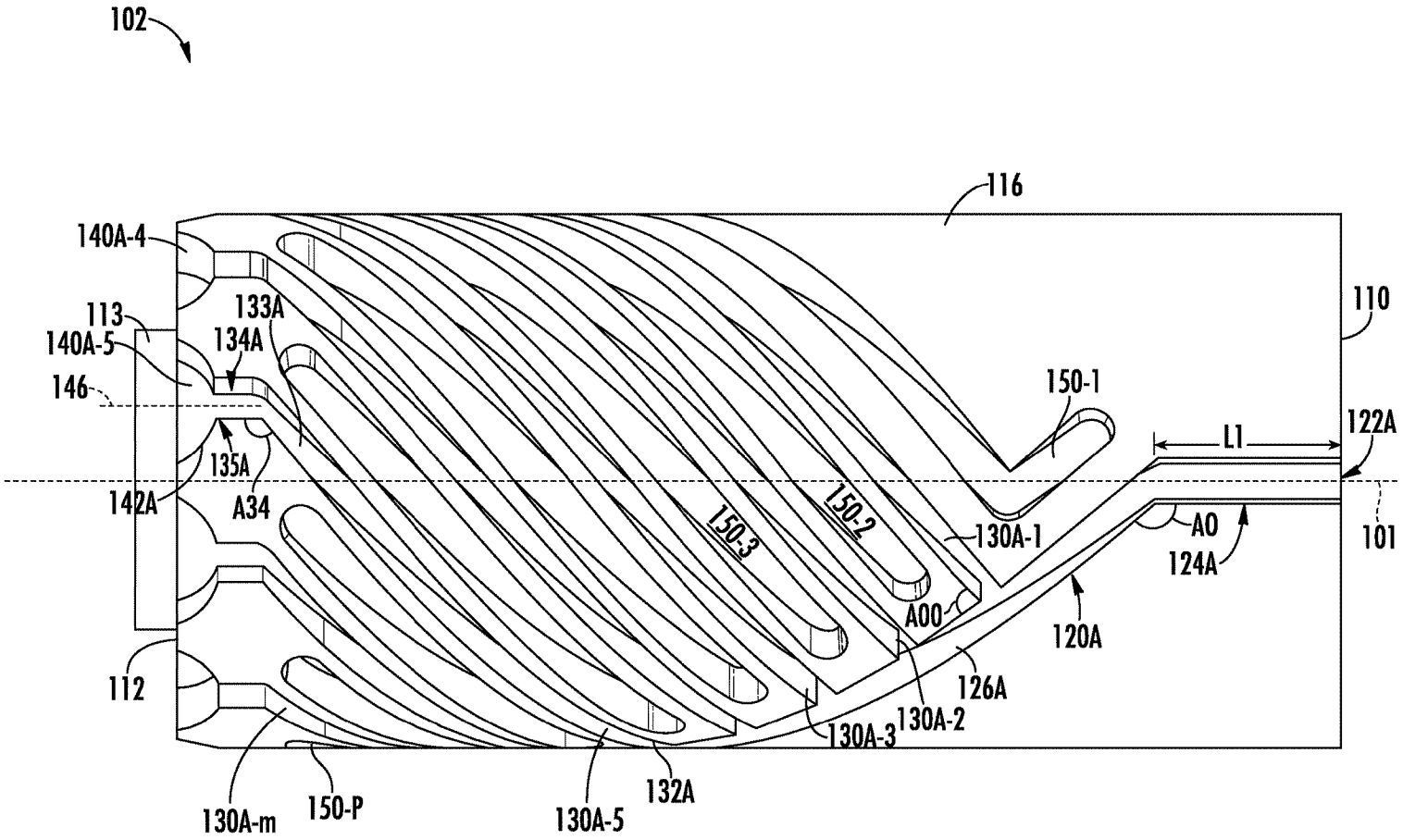
Figure 1C:
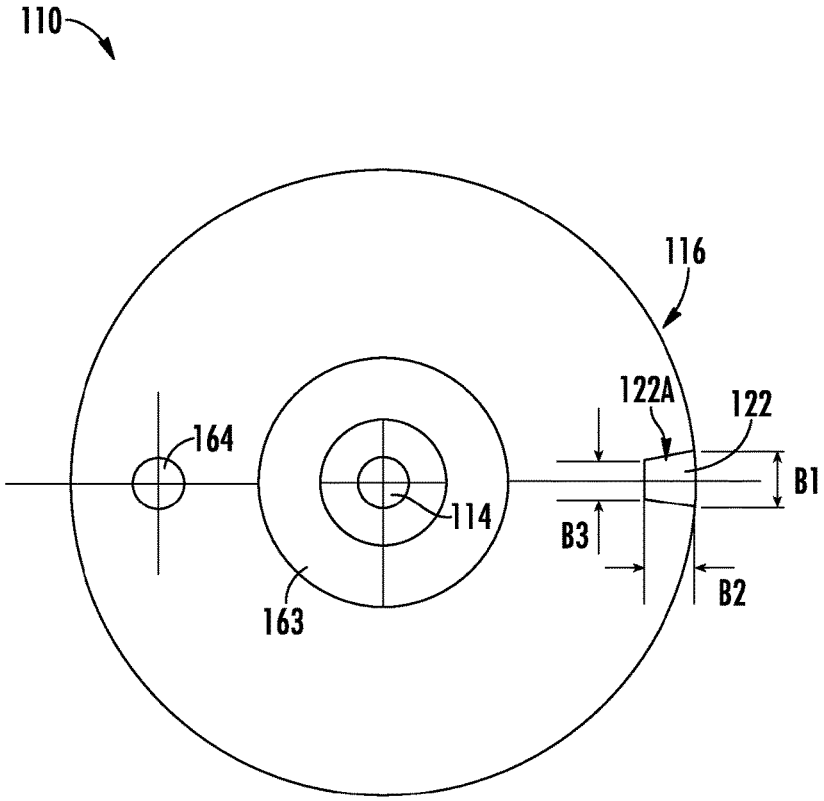
Figure 1D:
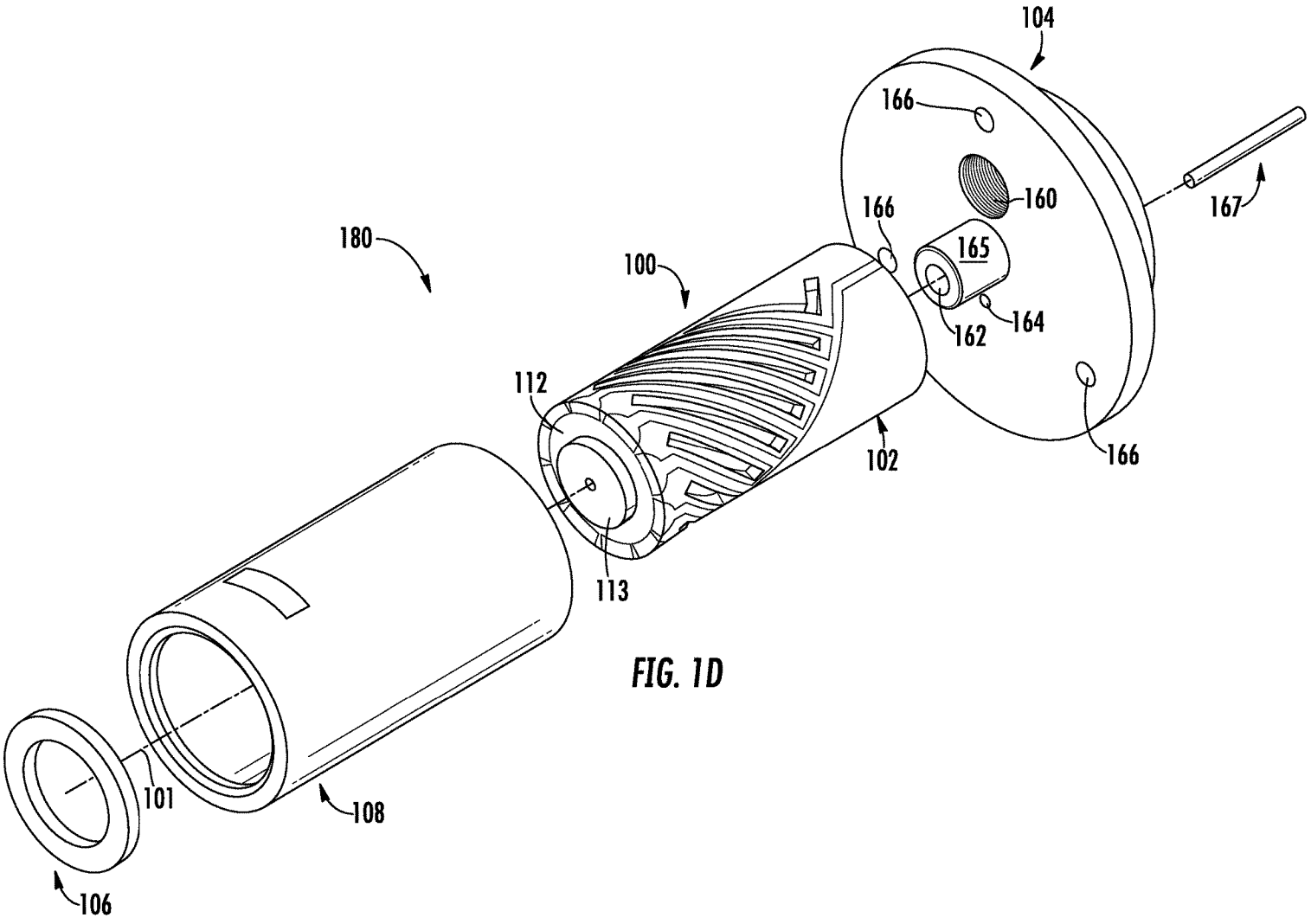

FIGS. 1A through 1D illustrate an example off-axis annular precision initiation charge (APIC), consistent with several embodiments of the present disclosure. FIG. 1A illustrates an off-axis APIC body 100 that includes a substrate body 102 and explosive material, consistent with one embodiment of the present disclosure. FIG. 1B illustrates the substrate body 102 of FIG. 1A, without the explosive material. FIG. 1C illustrates a top (first end) 110 of the off-axis APIC body 100 of FIG. 1A. FIG. 1D illustrates one example off-axis APIC assembly 180 that includes the off-axis APIC body 100 of FIG. 1A. FIGS. 1A through 1D may be best understood when considered together.

Turning first to FIG. 1A, the substrate body 102 may be formed of a substrate material. Substrate material may include, but is not limited to, a synthetic polymer such as a polyamide (e.g., Nylon 6/6, Nylon 6/10 or Nylon 6/12), etc. The substrate body 102 includes a top end 110 and an opposing bottom end 112. The substrate body 102 includes a curved outer surface 116 positioned between, and generally perpendicular, to the top end 110 and the opposing bottom end 112. For example, the substrate body 102 may be generally cylindrical. The top end 110 and the opposing bottom end 112 are generally parallel. As used herein, "generally cylindrical", "generally perpendicular" and "generally parallel" means cylindrical, perpendicular and parallel, respectively, to within manufacturing tolerances. For example, generally perpendicular and generally parallel mean perpendicular or parallel to within ±0.5 degree. In another example, generally cylindrical means any diameter of the corresponding cylinder is ±0.1 millimeter (mm) of a nominal diameter of the cylinder. The opposing bottom end 112 may include a bottom end boss 113 configured to receive an explosive booster, as described herein.

The substrate body 102 defines a clear sight bore aperture 114. The clear sight bore aperture 114 is centered at a longitudinal center axis 101 of the substrate body 102. The clear sight bore aperture 114 extends from the top end 110 to the opposing bottom end 112.

Turning now to FIG. 1B, the substrate body 102 includes a trunk line aperture 120A defined in the outer surface 116. The trunk line aperture 120A has a first end 122A positioned at the top end 110 of the substrate body 102. The first end 122A is positioned off-center from the center axis 101 of the substrate body 102. The trunk line aperture 120A has a first portion 124A that begins at the trunk line aperture first end 122A and extends generally parallel to the longitudinal center axis 101. The trunk line aperture 120A has a second portion 126A that extends from the first portion 124A to a termination adjacent the bottom end 112 of the substrate body 102. The second portion 126A of the trunk line aperture 120A has a generally helical shape. The trunk line aperture 120A is configured to contain a first explosive material. The first explosive material may include, but is not limited to, a penta erythritol tetranitrate (PETN), such as 85% PETN Primasheet® 1000, etc.

The substrate body 102 includes a plurality of helical track apertures 130A-1, 130A-2, . . . , 130A-m defined in the outer surface 116. Each helical track aperture, e.g., helical track aperture 130A-5, has a first end 132A, a first portion 133A, a second portion 134A and a second end 135A. The first portion 133A and the second portion 134A are coupled at an angle, A34, relative to each other. The first end 132A of the helical track aperture 130A-5 is coupled to the trunk line aperture 120A. Each helical track aperture 130A-1, 130A-2, . . . , 130A-m has a generally helical shape, a channel shaped cross-section and a respective helical track length. Each helical track aperture 130A-1, 130A-2, . . . , 130A-m is configured to contain the first explosive material, as described herein.

The substrate body 102 includes a plurality of termination aperture, e.g., termination aperture 140A-5, defined in the outer surface 116 and in the bottom end 112 of the substrate body 102. Each termination aperture is configured to contain the first explosive material, as described herein. Each termination aperture, e.g., termination aperture 140A-5, is positioned in the outer surface 116 of the substrate body 102 adjacent the bottom end 112. Each termination aperture is coupled to a respective helical track aperture second end, e.g., termination aperture 140A-5 is coupled to helical track aperture 130A-5 second end 135A. One termination aperture is coupled to the second portion 126A of the trunk line aperture 120A. For example, each termination aperture, e.g., termination aperture 140A-5, has a generally semicircular shape bounded by an arc (i.e., a curved) portion 142A, as described herein.

Each helical track aperture, e.g., helical track aperture 130A-5, may couple to a respective termination aperture, e.g., termination aperture 140A-5, along the arc portion 142A. For example, the helical track aperture 130A-5 may couple to the termination aperture 140A-5 along a section of the arc portion centered at a centerline, e.g., centerline 146, of the arc portion 142A. The trunk line aperture 120A may similarly couple to termination aperture along a corresponding arc portion of the termination aperture.

A respective size, i.e., a radius of the arc portion 142A and dimensions of the termination bottom surface 144, of each termination aperture may be related to a diameter of a main explosive charge, as described herein, and thus a diameter of the substrate body 102. The respective size may be related to a number of termination apertures and thus a number of helical track apertures. Dimensions of the helical track apertures and the trunk line aperture may be similarly related to the sizes of the termination apertures. For example, for a selected main explosive charge diameter, a corresponding substrate body may include relatively more, relatively smaller termination apertures or relatively fewer, relatively larger termination apertures. In an embodiment, the number of termination apertures may be in the range of six to thirty. The number and dimensions of the termination apertures are configured to facilitate providing a ring light to the main explosive charge when the termination apertures contain the first explosive material, as described herein.

The substrate body 102 may include a plurality of channel apertures 150-1, 150-2, . . . , 150-*p* defined in the outer surface 116. Each channel aperture 150-1, 150-2, . . . , 150-*p* is positioned adjacent at least one respective helical track aperture 130A-1, 130A-2, . . . , 130A-m. For example, a first channel aperture 150-1 is positioned adjacent a first helical track aperture 130A-1. In another example, each of the remaining channel apertures (excluding the first channel aperture 150-1) is positioned between a respective pair of adjacent helical track apertures. For example, a second channel aperture 150-2 is positioned between the first helical track aperture 130A-1 and a second helical track aperture 130A-2. The channel apertures 150-1, 150-2, . . . , 150-*p* are configured to prevent a detonation wave from traveling through substrate material of substrate body 102 and interfering with adjacent helical tracks.

Turning again to FIG. 1A, the following description of FIG. 1A is similar to the foregoing description of FIG. 1B, is presented in the context of a three-dimensional (3D) image and is configured to illustrate features of the substrate body, with explosive material, in a 3D environment. The substrate body 102 includes a trunk line 120. Trunk line 120 corresponds to the first explosive material contained in trunk line aperture 120A, illustrated in FIG. 1B. Thus, trunk line 120 includes a linear first portion 124 and a helical second portion 126 that correspond to the trunk line aperture first portion 124A and 126A, respectively. The trunk line 120 has a first end 122 positioned at the top end 110 of the substrate body 102. The first end 122 is positioned off-center from the center axis 101 of the substrate body 102. The trunk line first end 122 is configured to align with and couple to a detonator when the substrate body 102 is included in an APIC assembly, as described herein. The trunk line 120 has a first portion 124 that begins at the trunk line first end 122 and extends generally parallel to the longitudinal center axis 101. The trunk line 120 has a second portion 126 that extends from the first portion 124 to a termination adjacent the bottom end 112 of the substrate body 102. The second portion 126 of the trunk line 120 has a generally helical shape. Thus, the explosive material included in the trunk line aperture 120A, i.e., the trunk line 120, has a geometry that corresponds to the geometry of the trunk line aperture 120A.

The substrate body 102 includes a plurality of helical tracks 130-1, 130-2, . . . , **130-*m*. Each helical track 130-1, 130-2, . . . , 130-*m* corresponds to the first explosive material contained in a respective helical track aperture 130A-1, 130A-2, . . . , 130A-m. Each helical track, e.g., helical track 130-5, has a first end 132, a first portion 133, a second portion 134 and a second end 135. The first end 132 of the helical track is coupled to the trunk line 120. Each helical track 130-1, 130-2, . . . , 130-*m* has a generally helical shape. Thus, the explosive material, e.g., the helical track 130-5, included in the helical track aperture 130A-5, has a geometry that corresponds to the geometry of the helical track aperture 130A-5**.

The substrate body 102 includes a plurality of terminations 140-1, 140-2, . . . , **140-*n*. Each termination 140-1, 140-2, . . . , 140-*n* corresponds to the first explosive material contained in a respective termination aperture. Each termination, e.g., termination 140-5, is positioned in the outer surface 116 of the substrate body 102 adjacent the bottom end 112. Each termination, e.g., termination 140-5, is coupled to a respective helical track second end, e.g., helical track 130-5 second end 135. One termination, e.g., termination 140-*n*, is coupled to the second portion 126 of the trunk line 120. For example, each termination, e.g., termination 140-5, has a generally semicircular shape bounded by an arc (i.e., a curved) portion 142 and a termination bottom surface 144**.

Each helical track, e.g., helical track 130-5, may couple to a respective termination, e.g., termination 140-5, along the arc portion 142. For example, the helical track 130-5 may couple to the termination 140-5 along a section of the arc portion centered at a centerline, e.g., centerline 146, of the arc portion 142. The trunk line 120 may similarly couple to termination **140-*n* along a corresponding arc portion of the termination 140-*n*. The respective termination bottom surface of each termination, e.g., termination bottom surface 144 of the termination 140-5, may be positioned generally parallel to and adjacent the bottom end 112 of the substrate body 102. The termination bottom surface 144** is configured to couple to an explosive booster, as described herein.

The orientation (e.g., angle between the helical track first end and the trunk line and angle between the helical track second end and the corresponding termination) and respective lengths of each helical track 130-1, 130-2, . . . , **130-*m* are configured to facilitate detonation of the plurality of terminations 140-1, 140-2, . . . , 140-*n* within a selected target time interval. In one example, the target time interval duration may be 100 nanoseconds (ns). In another example, the target time interval duration may be 200 ns. The detonation of the plurality of terminations 140-1, 140-2, . . . , 140-*n*** may thus provide a ring light and corresponding uniform detonation wave to a main explosive charge when an off-axis APIC assembly is coupled to the main explosive charge.

A respective size, i.e., a radius of the arc portion 142 and dimensions of the termination bottom surface 144, of each termination may be related to a diameter of a main explosive and thus a diameter of the substrate body 102. The respective size may be related to a number of terminations and thus a number of helical tracks. Dimensions of the helical tracks and the trunk line may be similarly related to the sizes of the terminations. For example, for a selected main explosive charge diameter, a corresponding substrate body may include relatively more, relatively smaller terminations or relatively fewer, relatively larger terminations. In an embodiment, the number of terminations may be in the range of six to thirty. The number and size of the terminations may be selected to facilitate providing ring light to a main explosive charge, as described herein.

Turning now to FIG. 1C, the top end 110 of the substrate body 102 includes the clear sight bore aperture 114 and the trunk line aperture first end 122A that corresponds to the trunk line first end 122. The clear sight bore aperture 114 and the trunk line aperture first end 122A are defined in the top end 110. The top end 110 may further include an end cap receiver aperture 163 defined in the top end 110. The end cap receiver aperture 163 is generally circular and generally centered on the clear sight bore aperture 114 and, thus, the longitudinal center axis 101 of the substrate body 102. Generally circular means any diameter is within ±0.1 mm of a nominal diameter and generally centered means within ±0.5 mm of a center point. The end cap receiver aperture 163 is configured to receive an end cap bushing portion of an end cap, as described herein.

The top end 110 may further include a dowel pin aperture 164 defined in the top end 110. The dowel pin aperture 164 is configured to facilitate positioning an end cap relative to the APIC body 100 and thus substrate body 102. The dowel pin aperture 164 is positioned off-center from the longitudinal center axis 101 and may generally oppose the trunk line aperture first end 122A.

The trunk line aperture first end 122A is positioned adjacent the substrate body outer surface 116. The trunk line first end 122 has an outer circumferential dimension B1, a radial dimension B2, and an inner circumferential dimension B3. The outer circumferential dimension B1 may be generally continuous with the substrate body outer surface 116. The trunk line first end 122 is configured to couple to a detonator when the APIC body 100 and thus substrate body 102 is included in an explosive system. For example, the trunk line first end 122 may align with a detonator aperture included in an end cap, as described herein.

Turning now to FIG. 1D, off-axis APIC assembly 180 includes APIC body 100, an end cap 104, an explosive booster 106 and a tamper 108. The APIC body 100 includes substrate 102 and the trunk line, plurality of helical tracks and plurality of terminations, as described herein. The explosive booster 106 may include an explosive material and is configured to facilitate a ring light, as described herein. The tamper 108 is configured to contain the explosive initiation charge within the tamper 108, between the end cap 104 and a main explosive charge, as described herein. In other words, the tamper 108 is configured to contain a detonation wave, initiated by a detonator, and configured to travel from the off-axis trunk line first end 122 along the trunk line 120 and plurality of helical tracks 130-1, . . . , **130-*m* to the plurality of terminations 140-1, . . . , 140-*n* and from the plurality of terminations to the explosive booster 106** and main explosive charge.

End cap 104 is configured to couple to APIC body 100. End cap 104 defines a detonator aperture 160 and an end cap aperture 162. The detonator aperture 160 is configured to align with the first end 122 of the trunk line 120 when the end cap 104 is coupled to the APIC body 100. The detonator aperture 160 is configured to receive a detonator. Detonators may include, but are not limited to, a blasting cap (e.g., M6 (electric detonator), M7 (nonelectric detonator)), an exploding bridge wire detonator (e.g., RP-87 (explosive contained in stainless steel case), RP-83 (standard end lighting detonator)), etc. In some embodiments, the detonator aperture 160 may be threaded to facilitate mounting and fixing the detonator in the detonator aperture 160.

End cap 104 includes an end cap bushing 165. The end cap bushing 165 is configured to fit in the end cap receiver aperture 163 when the end cap 104 is coupled to the APIC body 100. The end cap aperture 162 is configured to align with the clear sight bore aperture 114 when the end cap 104 is coupled to the APIC body 100.

End cap 104 may further define a dowel pin aperture 164 configured to receive a dowel pin 167. The dowel pin 167 may be configured to facilitate aligning the end cap 104 and the APIC body 100. End cap 104 may further define a plurality of mounting apertures 166 configured to facilitate coupling end cap 104 to a housing, e.g., in an explosive system. End cap 104 may be coupled to substrate body 102 by, for example, an adhesive material. Adhesive material may include, but is not limited to, a general purpose instant adhesive such as an ethyl cyanoacrylate (e.g., Loctite® 404™), etc.

The explosive booster 106 is configured to couple to the APIC body 100 and the substrate body 102 at the bottom end 112. The bottom end boss 113 of the substrate body 102 is configured to facilitate positioning the explosive booster 106 relative to the bottom end 112. The explosive booster 106 is configured to couple to the plurality of terminations 140-1, 140-2, . . . , **140-*n* and to facilitate forming a uniform ring light to a main explosive charge. Utilizing the explosive booster 106 rather than extending the terminations may facilitate ease of manufacturing. In an embodiment, the explosive booster 106 may be configured to extend from the outer surface 116 of the substrate body 102 to a distance of one half a radius of a top end of a main explosive charge (and thus one half a radius of substrate 102), as described herein. Extending to the one half radius of the top end of the main explosive charge is configured to facilitate generating a generally symmetrical ring light for the main explosive charge. The explosive booster 106** may be formed of a second explosive material. The second explosive material may include, but is not limited to, a nitroamine high explosive, such as PBXN-5 (polymer bonded explosive, HMX 95%, fluoroelastomer 5%), etc.

In one nonlimiting example, the substrate body 102 may have a diameter of 25 millimeters (mm) and a length of 57.5 mm±0.25 mm. The substrate body 102 may then include ten termination apertures, nine helical track apertures and one trunk aperture defined in the outer surface 116 of the substrate body 102. All length, width and depth dimensions provided herein have units of millimeters (mm) and a tolerance of ±0.5 mm, unless indicated otherwise. All angles provided herein have units of degrees and a tolerance of ±0.5 degree, unless indicated otherwise. The trunk line aperture 120A and each helical track aperture has a depth of 2 mm and a width of 1.5 mm. The trunk line aperture first end 122A has an outer circumferential dimension of 2 mm, an inner circumferential dimension of 1.68 mm and a radial dimension of 1.95 mm. The respective arc portion of each termination aperture 140A-1, 140A-2, . . . , 140A-n has a radius of 3.25 mm and the respective termination bottom surface 144 has a length of 5.3 mm, measured in a circumferential direction.

The trunk line aperture 120A first portion 124A has a length, L1. The trunk line aperture second portion 126A has a length, L2. L1 has a length of 9 mm and the trunk line aperture 120A has a total length L1+L2 of 66 mm. An angle, A0, between the first portion 124A and the second portion 126A is 145 degrees. Each helical track aperture has a respective helical track length. Beginning with helical track aperture 130A-1, the respective helical track aperture lengths are 55 mm, 50 mm, 44 mm, 38 mm, 32 mm, 26 mm, 21 mm, 16 mm and helical track aperture 130A-m (m=9) has length 10 mm. Center to center spacing between adjacent helical track apertures, e.g., helical track apertures 130A-1 and 130A-2, is 4.85 mm. Helical track aperture to adjacent channel aperture, e.g., helical track aperture 130A-1 and channel aperture 150-2, center to center spacing is 4.85/2=2.425 mm. A spacing between each channel aperture 150-1, 150-2, . . . , **150-*p* and the trunk line aperture 120A (e.g., the trunk line aperture second portion 126**A) is 1.75 mm. Each channel aperture has a depth of 2 mm, a width of 2 mm and a respective length related to length(s) of adjacent helical track aperture(s).

An angle, A00, between the trunk line aperture 120A and each helical track aperture at the respective helical track first end is 99 degrees. An angle, A34, between a helical track first portion, e.g., first portion 133A, and a helical track second portion, e.g., second portion 134A, is 135 degrees. Similarly, an angle (not shown) between the trunk line aperture 120A and a centerline of a corresponding termination aperture is 156 degrees.

Thus, in one example, the APIC body 100 and thus substrate body 102 may have length of 57.5 mm±0.25 mm and a diameter of 25 mm. In other examples, the length and diameter of the APIC body (and substrate body), dimensions related to the trunk line aperture, helical track apertures, channel apertures and termination apertures and numbers of helical track apertures, channel apertures and termination apertures may be larger or smaller. For example, a diameter of the substrate body may be selected based, at least in part, on a diameter of an explosive charge configured to couple to an APIC assembly that includes the APIC body. Continuing with this example, the diameter of the explosive charge may be related to a particular application of the corresponding explosive system. In other examples, depending on each application, dimensional tolerances may be relaxed or may be relatively precise, with the precision defined by the application.

Thus, an off-center APIC assembly may include an APIC body that includes a substrate body that defines a trunk line aperture, a plurality of helical track apertures and a plurality of termination apertures. The substrate body may further define a plurality of channel apertures, as described herein. The APIC body may further include a trunk line, a plurality of helical tracks and a plurality of terminations, as described herein. The APIC assembly includes a center aperture configured to provide an unobstructed continuous bore aperture from a top end of the APIC assembly to an opposing bottom end of the APIC assembly. The APIC assembly is configured to couple to a main explosive charge at the bottom end of the APIC assembly. The main explosive charge may be a shaped charge or an explosively formed projectile.

Figure 2A:
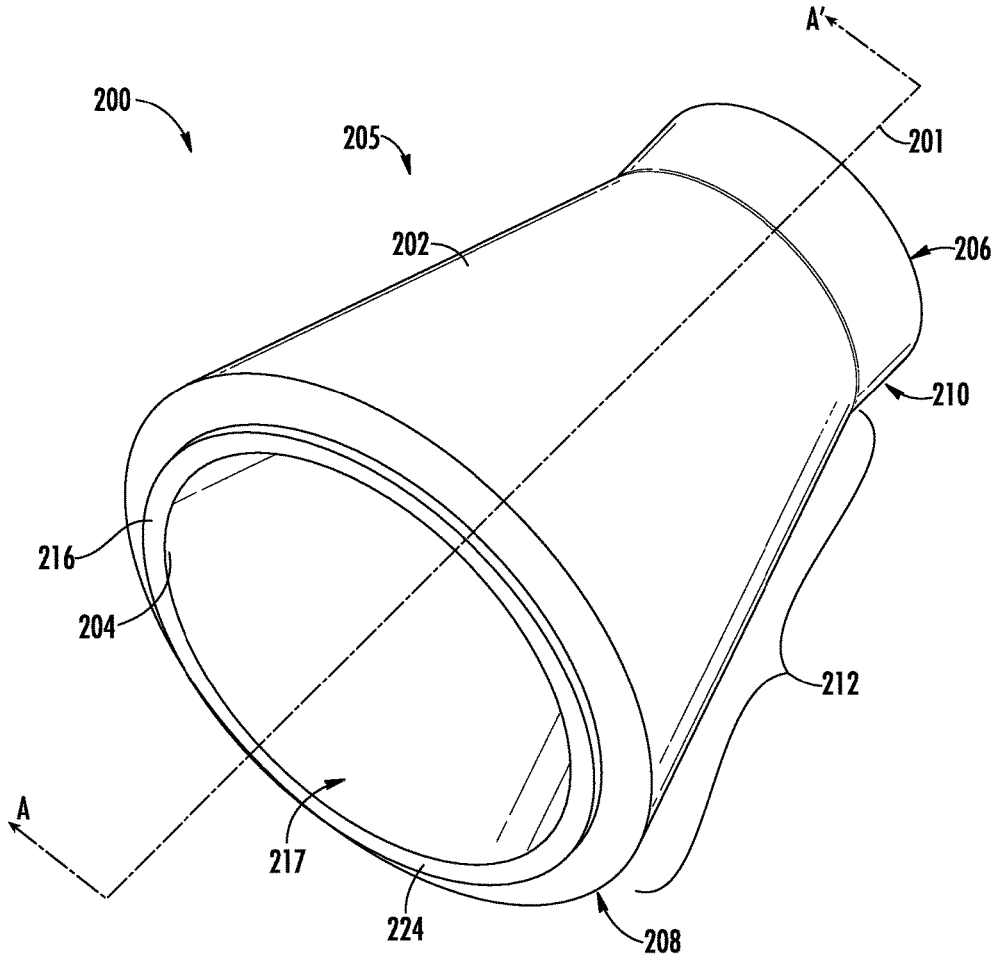
FIGS. 2A and 2B illustrate an example shaped charge, consistent with several embodiments of the present disclosure.
Figure 2B:
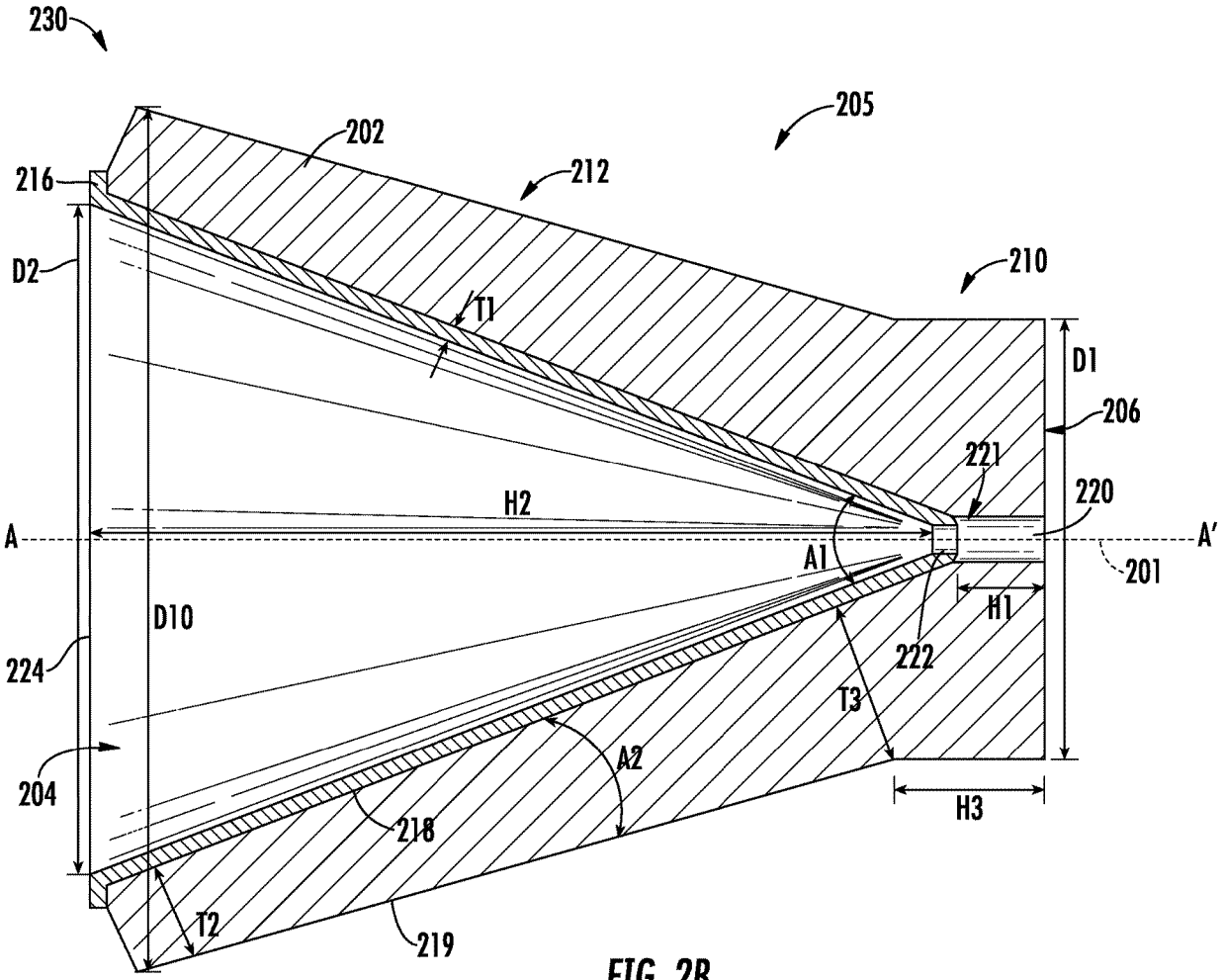

FIGS. 2A and 2B illustrate an example shaped charge 205, consistent with several embodiments of the present disclosure. FIG. 2A is a perspective view 200 of the example shaped charge 205 and FIG. 2B is a cross-section (A-A') 230 of the example shaped charge 205 of FIG. 2A.

Turning first to FIG. 2A, shaped charge 205 includes an explosive region 202 and a liner 204. The liner 204 may be formed of a liner material. The liner material may include, but is not limited to, copper (e.g., oxygen-free high conductivity (OFHC) copper), steel, a steel alloy (e.g., chromoly (a steel alloy made principally of chromium and molybdenum)), etc. The explosive region 202 may include a main explosive material. The main explosive material corresponds to an insensitive munition explosive. Insensitive munition explosives are designed to withstand stimuli representative of severe but credible accidents. Stimuli may include, but are not limited to, shock (e.g., from bullets, fragments and/or shaped charge jets), heat (e.g., from fire and/or adjacent thermal events) and adjacent detonating munitions. Insensitive munition explosives may include, but are not limited to, a polymer-bonded explosive (PBX), e.g., PBXN-5, PBXN-9, LX-14, etc. PBXN-5 corresponds to HMX (a nitroamine high explosive) 95% and fluoroelastomer 5%. PBXN-9 corresponds to HMX 92%, HYTEMP 4454 2% and Diisooctyl adipate 6%. LX-14 corresponds to HMX 95.5%, Estane and 5702-Fl 4.5%.

The perspective view 200 of the shaped charge 205 includes a shaped charge center line 201 that corresponds to a longitudinal center line of the shaped charge 205. The explosive region 202 is positioned on an outer surface of the liner 204. The shaped charge 205 includes a top end 206 and an opposing bottom end 208. The top end 206 of the shaped charge is configured to interface with an APIC body, e.g., APIC body 100. In other words, the top end 206 corresponds to a "strike face" of the shaped charge 205. A diameter of the top end 206 is configured to correspond to a diameter of the APIC body.

The liner 204 has a bottom end 224 positioned at the bottom end 208 of the shaped charge 205. The bottom end 224 of the liner 204 includes a liner ring 216 and defines a liner opening 217. The liner ring 216 is oriented generally perpendicular to the center line 201 and is positioned adjacent the bottom end 208 of the shaped charge 205.

The shaped charge 205 may include a top portion 210 positioned adjacent the top end 206. The shaped charge 205 includes a body portion 212 positioned between the top portion 210 (if present) or the top end 206, and the bottom end 208. The top portion 210 has a generally cylindrical shape and the body portion 212 has a generally conical shape with a peak of the cone removed. In other words, the peak of the cone is sliced off, parallel to a base of the cone. In this example, the base of the cone corresponds to the bottom end 224 of the liner 204. In some examples, the top portion may not be present and the body portion 212 may then extend to the top end 206.

Turning now to FIG. 2B, liner 204 (excluding the liner ring 216) has a generally conical shape. As used herein, generally conical corresponds to conical to within ±0.5 mm, in any dimension. The liner opening 217 corresponds to the base of the cone. An apex 221 of the conical liner 204 is positioned a distance, H1, from the top end 206 of the shaped charge 205. The distance, H1, corresponds to a head height of the shaped charge 205.

The explosive region 202 includes an explosive bore aperture 220. The explosive bore aperture 220 is defined by the explosive region 202 and is centered about the shaped charge center line 201. The liner 204 defines a liner bore aperture 222 positioned at the apex 221 of the liner 204 and centered about the shaped charge center line 201. Thus, the explosive bore aperture 220 and liner bore aperture 222 are configured to provide a continuous clear sight bore from the top end 206 of the shaped charge 205 through the shaped charge 205 to the bottom end 208.

The top end 206 has a diameter, D1. A value of the diameter, D1, is related to the diameter of the APIC body and corresponding substrate body, e.g., APIC body 100 and substrate body 102.

The liner 204 has a thickness, T1, and a cone height, H2, measured from the liner bore aperture 222 to the bottom end 224 of the liner 204. The bottom end 224 of the liner has a diameter, D2. The liner 204 has a cone angle, A1. The cone angle, A1, may be in the range of 36 degrees to 45 degrees. For example, the cone angle, A1, may be 42°. The body portion 212 has a flare angle, A2, measured between an outer surface 218 of the liner and an outer surface 219 of the explosive region body portion 212. The body portion 212 has a body portion bottom thickness, T2, adjacent the bottom end 208 of the shaped charge 205 and a body portion top thickness, T3, adjacent the top portion 210.

The top portion 210 has a top height, H3, measured from the top end 206 to the body portion 212. The top height, H3, is related to the diameter, D1, and the flare angle, A2. In the example shaped charge 205, the apex 221 of the liner 204 is included in the top portion 210. In some example shaped charges, the top portion 210 may not be present. For example, the flare angle A2 may be zero and the body portion bottom thickness T2 may equal body portion top thickness T3. The body portion thickness may then be related to top end diameter, D1, and the bottom end diameter, D2.

The bottom end 224 diameter, D2, of the shaped charge liner 204 (excluding the liner ring 216) corresponds to a charge diameter of the shaped charge 205. A distance, e.g., an offset, that an explosive system that includes a shaped charge may be placed from a target is related to the charge diameter. The offset affects operation of the explosive system. Generally, a shaped charge positioned at the offset (i.e., distance from a target measured in charge diameters) is configured to deliver a mass of jet material at the target (or target device) without secondary effects. Secondary effects may include overpressure (e.g., a blast) and/or fragmentation (e.g., liner particulation). Liner particulation may occur when the apex 221 of the liner 204 is traveling much faster than the bottom end 224 of the liner 204. Secondary effects are more likely to occur as the offset increases. For example, for a weapons system, the explosive system may be positioned at an offset of four to six charge diameters from the target so that an armor piercing jet may form. In another example, for a tool application, the explosive system may be positioned at an offset of twelve to eighteen charge diameters from the target. The relatively greater offset of the tool application may be relatively safer (e.g., for explosive ordnance technicians). Thus, for a tool application, due to the relatively larger offset, secondary effects may be more likely to occur. Dimensions of the shaped charge and/or net explosive weight (N.E.W.) of the explosive region may be selected to reduce a likelihood of secondary effects.

In an embodiment, a geometry of the shaped charge, e.g., one or more dimensions of the shaped charge, may be "tuned" for the tool application to reduce and/or eliminate the velocity differential (e.g., velocity gradient) in the liner material and thus the associated secondary effects. For example, the one or more dimensions may be selected based, at least in part, on the offset and/or based, at least in part, on a desired penetration of the target.

The geometry of the shaped charge 205 affects a N.E.W. of the explosive region 202 and thus the N.E.W. of the shaped charge 205. In an embodiment, the flare angle, A2, may be adjusted to reduce the velocity gradient of the liner 204 material as the liner collapses. In other words, changing the flare angle, A2, is configured to change a corresponding velocity differential profile of the liner to reduce the velocity differential between the tip of the jet material (i.e., the apex of the liner) and the base of the jet material (i.e., the base of the liner). A reduced (or eliminated) velocity differential may then correspond to a coherent projectile flying into a target and reduced or eliminated liner particulation.

In another embodiment, the flare angle, A2, may be adjusted to reduce and/or minimize the N.E.W. while achieving a specified depth of penetration into a target. The N.E.W. may be reduced relative to an explosive region having a generally cylindrical outer surface that is continuous over the head portion and the body portion. Reducing and/or minimizing the N.E.W. may reduce and/or a minimize the blast pressure and/or liner particulation, i.e., may reduce secondary effect(s). Reducing the secondary effects by reducing the N.E.W. may then facilitate increasing the offset.

The flare angle, A2, may range from zero to one half of the cone angle, A1. A flare angle, A2, equal to one half of the cone angle, A1, corresponds to the top end diameter, D1, equal to a bottom diameter, D10, of the shaped charge 205. A flare angle, A2, of zero, a top height, H3, of zero and thus the body portion bottom thickness, T2, equal to the body portion top thickness, T3, may correspond to a maximum N.E.W. for a selected cone angle. A same selected cone angle, a nonzero flare angle, A2, and a nonzero top height, H3, correspond to a N.E.W. less than the maximum N.E.W., for the selected cone angle. Thus, the flare angle, A2, and/or the top height, H3, may be adjusted to achieve a relatively low N.E.W., a specified depth of penetration and/or to tune the liner material velocity gradient for a given top end diameter. In other words, the given top end diameter may be constrained by APIC assembly substrate body diameter and the cone angle.

Figure 2C:
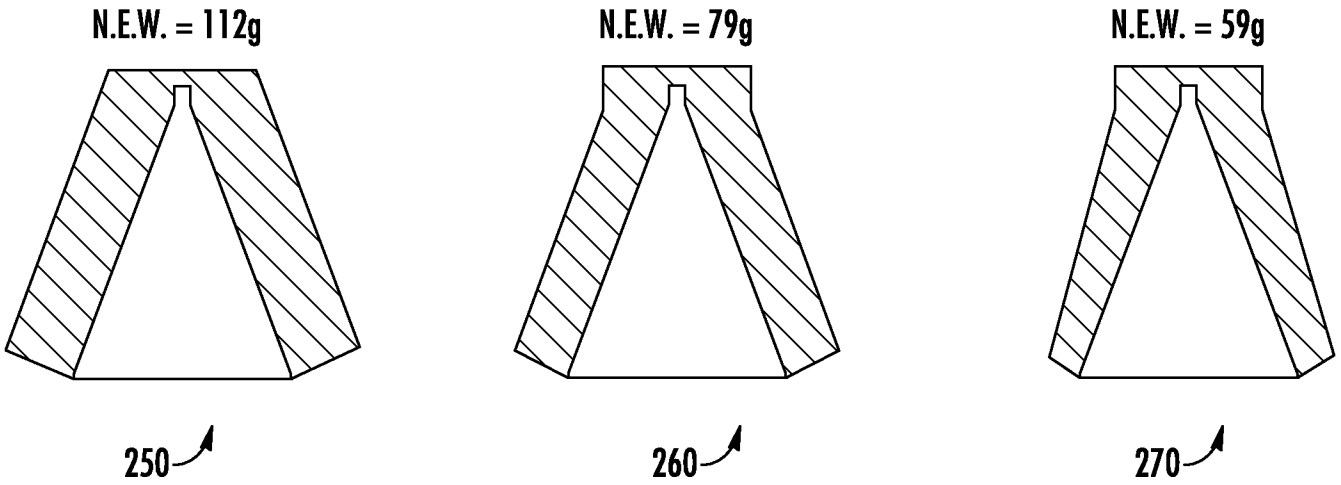
FIG. 2C illustrates three example shaped charges and corresponding net explosive weights (N.E.W.)

FIG. 2C illustrates three example shaped charges 250, 260, 270 and a corresponding respective net explosive weight (N.E.W.) for each example shaped charge. The cone angle is 42 degrees, the top end diameter is 25 mm and the head height is 8 mm for each example shaped charge. The cone heights are 48.5 mm and are the same for the three examples. In the first example 250, the top height and the flare angle are both zero and the N.E.W. is 112 grams (g). In the second example 260, the top height is about 16 mm, the flare angle is zero and the N.E.W. is 79 g. In the third example 270, the top height is about 16 mm, the flare angle is about 9 degrees and the N.E.W. is 59 g. Thus, the nonzero flare angle of example 270 provides a smaller N.E.W. compared to example 260.

Thus, the flare angle, A2, and/or top height, H3, of a shaped charge may be adjusted and/or selected to reduce a N.E.W. and to thus reduce and/or eliminate secondary effects while achieving a specified depth of penetration.

Figure 3:
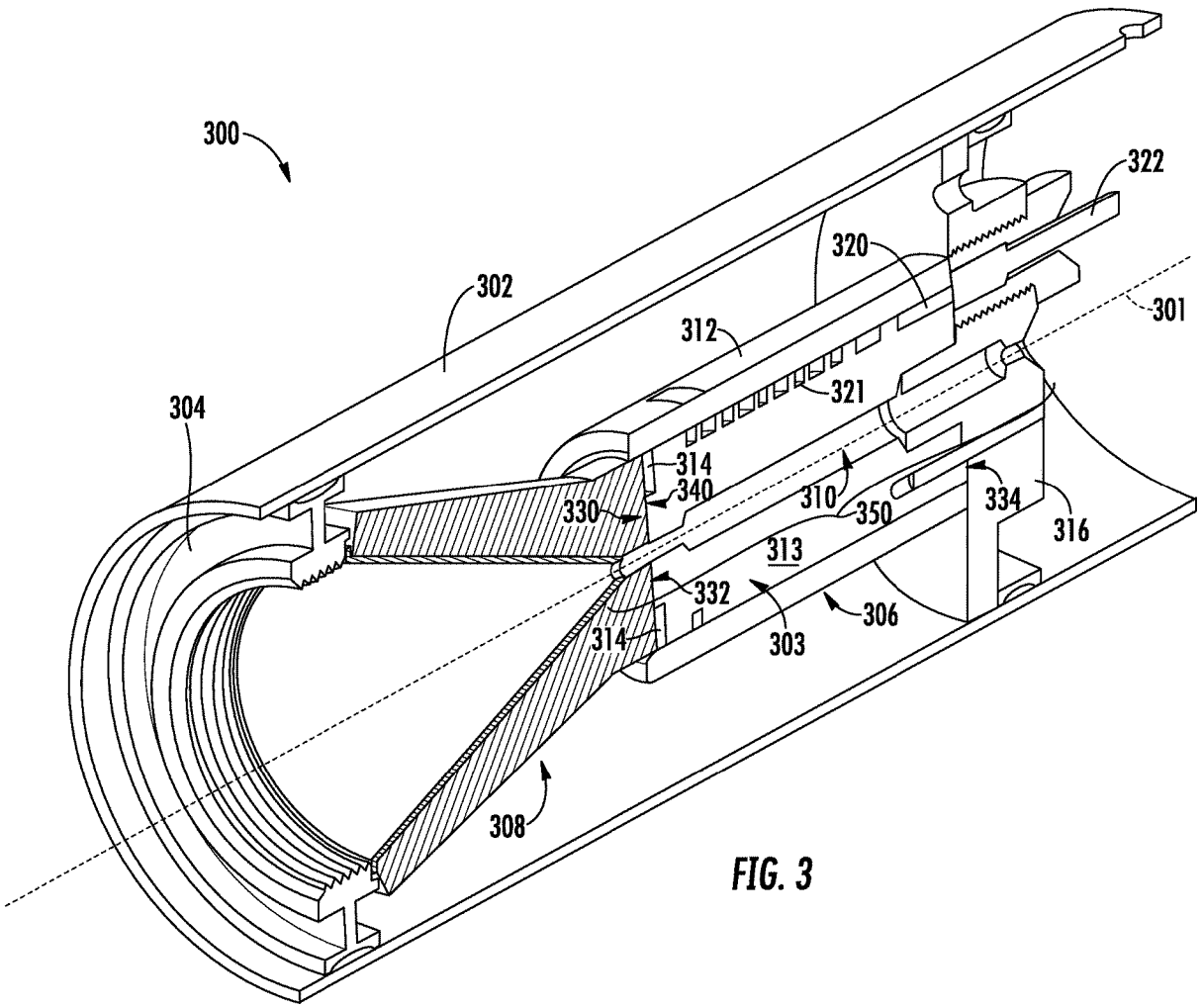
FIG. 3 illustrates a cross-section of an example explosive system including an off-axis APIC and a shaped charge, consistent with several embodiments of the present disclosure.

FIG. 3 illustrates a cross-section of an example explosive system 300 including an off-axis APIC assembly 306 and a shaped charge 308, consistent with several embodiments of the present disclosure. Off-axis APIC assembly 306 is one example of off-axis APIC assembly 180 of FIG. 1D. Shaped charge 308 is one example of shaped charge 205 of FIGS. 2A and 2B. The explosive system 300 further includes a housing 302 and a bottom retention ring 304. The example explosive system 300 includes a continuous bore aperture 350 centered on an explosive system 300 centerline 301.

The off-axis APIC assembly 306 includes an APIC body 303, a tamper 312, an explosive booster 314 and an end cap 316. The APIC body 303 includes a substrate body 313, a trunk line 320 and a plurality of helical tracks, e.g., helical track 321. The explosive system 300 further includes a detonator 322 included in end cap 316 and coupled to the trunk line 320. The APIC assembly 306 defines a clear sight bore aperture 310 centered on the explosive system 300 centerline 301. The off-axis APIC assembly 306 is coupled to a top end 332 of the shaped charge 308 at a bottom end 330 of the APIC body 303. The explosive booster 314 is positioned at the bottom end 330 and extends to a one half radius point 340 of the top end 332 of the shaped charge 308, as described herein.

Thus, a shaped charge may be coupled to an off-axis APIC assembly and a continuous bore aperture, e.g., continuous bore aperture 350, may traverse the explosive system 300, providing an unobstructed path for a laser light beam through the explosive system 300.

Figure 4A:
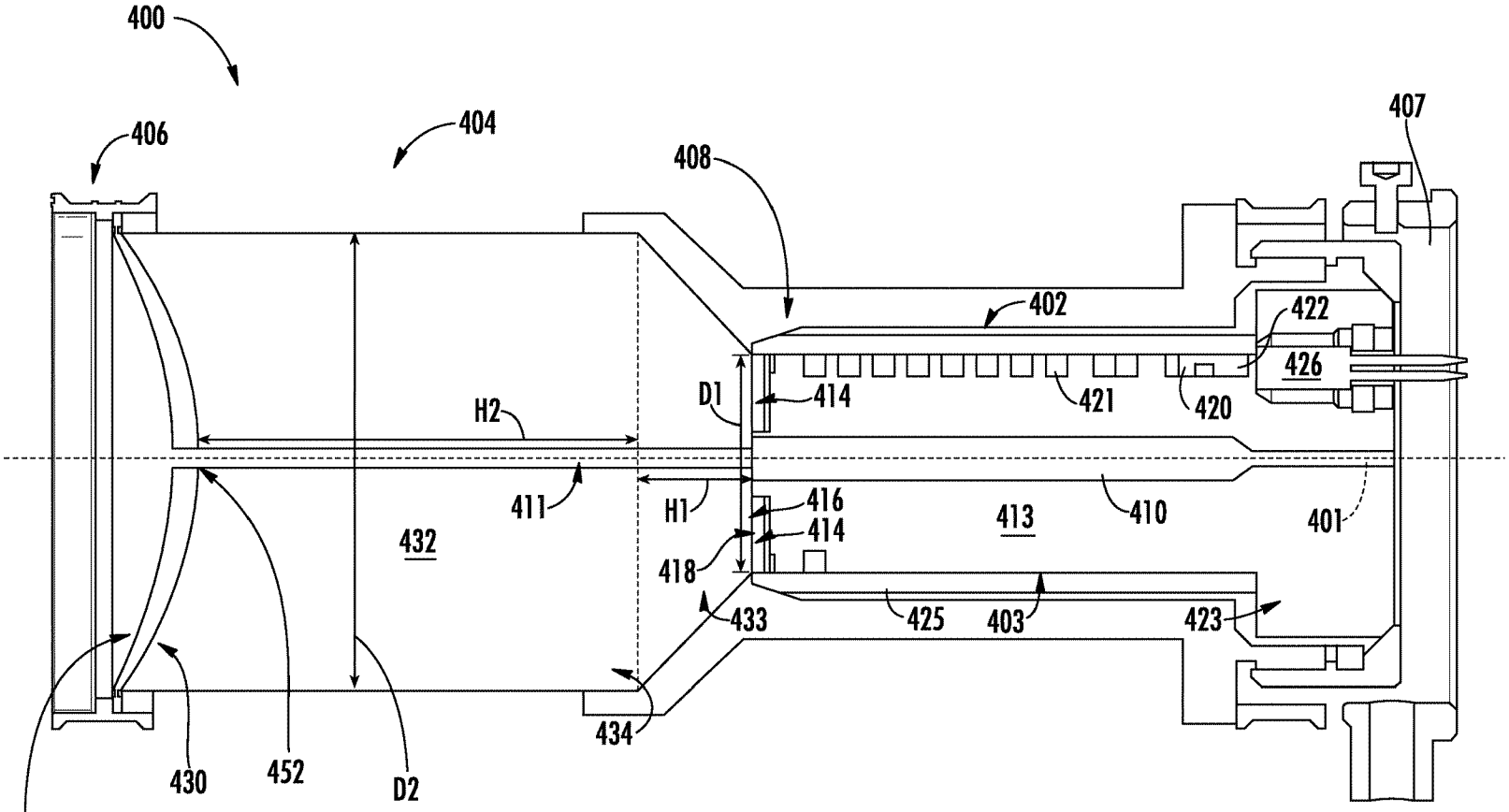
FIGS. 4A through 4D illustrate an example explosively formed projectile (EFP), consistent with several embodiments of the present disclosure.
Figure 4C:
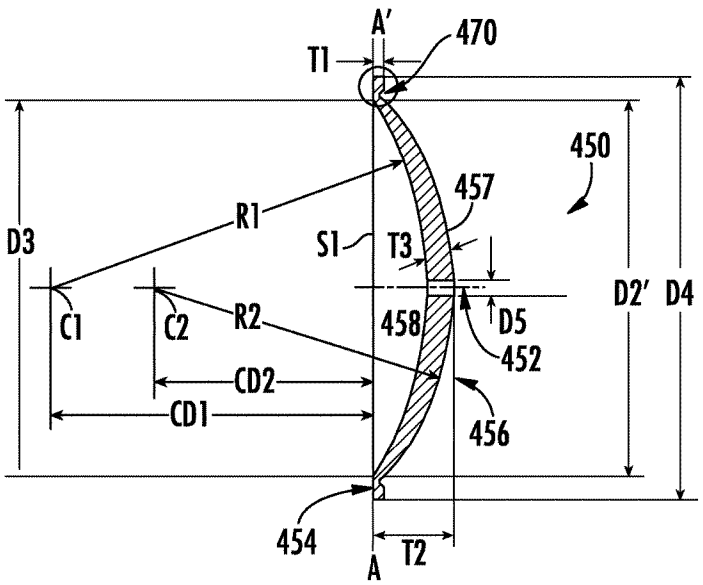
Figure 4D:
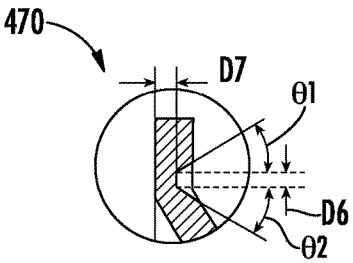
Figure 4B:
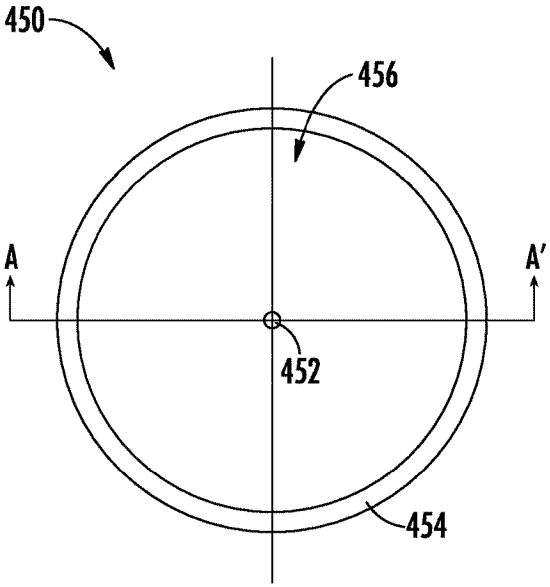

FIGS. 4A through 4D illustrate an example explosively formed projectile (EFP), consistent with several embodiments of the present disclosure. FIG. 4A illustrates an example explosive system 400 that includes an off-axis APIC assembly 402 and an example explosively formed projectile (EFP) 404, consistent with several embodiments of the present disclosure. FIG. 4B illustrates a top view of a liner 450. FIG. 4C illustrates a cross-section (A-A') of the liner 450 of FIG. 4B. FIG. 4D illustrates a liner ring slot 470. FIGS. 4A through 4D may be best understood when considered together.

Turning first to FIG. 4A, the explosive system 400 further includes a bottom retention ring 406, a top retention ring 407, a housing 408 and a detonator 426. The APIC assembly 402 is coupled between the top retention ring 407 and the EFP 404. The EFP 404 is coupled between the APIC assembly 402 and the bottom retention ring 406.

The APIC assembly 402 includes an APIC body 403, an end cap 423, an explosive booster 414 and a tamper 425. The APIC body 403 includes a substrate body 413, a trunk line 420 and a plurality of helical tracks, e.g., helical track 421. The detonator 426 is coupled to the end cap 423 and to a top end 422 of the trunk line 420. The APIC assembly 402 defines a continuous clear sight bore aperture 410 centered along a center axis 401 that extends from at least the end cap 423 to a bottom end 418 of the APIC assembly 402.

The EFP 404 has a top end 416 and a bottom end 417. The EFP 404 has a first diameter, D1, at the top end 416. The EFP 404 is coupled to the bottom end 418 of the APIC body 403 at the top end 416 of the EFP 404. The EFP 404 is coupled to the bottom retention ring 406 at the bottom end 417 of the EFP 404.

The EFP 404 includes an explosive region (EFP explosive region) 432 and a liner (crescent liner) 430. The liner 430 has a generally curved shape with a generally crescent shaped cross section, as will be described in more detail below. The explosive region 430 may be formed of a main explosive material, as described herein. The liner 430 may be formed of a liner material, as described herein. The explosive region 432 defines an explosive bore aperture 411 centered on center axis 401 and thus aligned with clear sight bore aperture 410. The liner 430 defines a liner bore aperture 452 centered on center axis 401 and thus aligned with clear sight bore aperture 410 and explosive bore aperture 411. Thus, the clear sight bore aperture 410, explosive bore aperture 411 and liner bore aperture 452 correspond to a continuous bore aperture that traverses the explosive system 400.

The explosive region 432 includes two explosive portions 433 and 434. The first explosive portion 433 is positioned adjacent the bottom end 418 of the off-axis APIC assembly 402, between the bottom end 418 of the off-axis APIC assembly 402 and the second explosive portion 434. The second explosive portion 434 is positioned adjacent the first explosive portion 433, between the first explosive portion 433 and the liner 430. The first explosive portion 433 is generally shaped as a conical frustrum (i.e., a cone with the top cut off parallel to the base of the cone). The second explosive portion 434 is generally cylindrically shaped. The first explosive portion 433 has a first height, H1, a top diameter, D1, and a bottom diameter, D2. The second explosive portion 434 has a diameter, D2, and a second height, H2.

The dimensions of the explosive region 432 are related to the application of explosive system 400. The diameter D1 is configured to correspond to a diameter of the APIC body 403. The diameter D2 may vary and is related to the application of explosive system 400. In one example, the diameter, D2, may be greater than the diameter D1 and thus greater than the diameter of the APIC body 403 (and the substrate body 413). In another example, the diameter D2 may be equal to the diameter D1.

Turning now to FIG. 4B, the liner 450 includes the liner bore aperture 452, a liner ring portion 454 and a liner curved portion 456. The liner bore aperture 452 is centered in the liner curved portion 456. The liner ring portion 454 is coupled to and surrounds the liner curved portion 456.

Turning now to FIG. 4C, the liner ring portion 454 has a thickness, T1. The liner 450 have an overall thickness, T2, that includes a curvature of the liner 450. The overall thickness, T2, is measured from a line, S1, that intersects the liner ring portion 454 at a bottom surface. The line, S1, corresponds to a diameter of the liner ring portion 454 and a secant of an outer surface 458 of the liner curved portion 456. The liner curved portion 456 has an inner diameter, D2', and an outer diameter D3. The liner ring portion 454 has an outer diameter D4. The liner ring portion 454 defines a liner ring slot 470. The liner bore aperture 452 has a diameter, D5, and is positioned at a center of the liner curved portion 456. The liner curved portion 456 has an inner surface 457 opposing the outer surface 458.

The liner outer surface 458 has an outer radius, R1. The liner inner surface 457 has an inner radius, R2. The outer radius R1, has a corresponding outer radius center, C1, positioned a first distance, CD1, from the line, S1. The inner radius, R2, has a corresponding inner radius center, C2, positioned a distance, CD2, from the line S1. The liner curved portion 456 has a thickness T3 that varies between the liner ring portion 454 and the liner bore aperture 452. In this example liner, the thickness, T3, is a minimum adjacent the liner ring portion 454 and a maximum adjacent the liner bore aperture 452.

Turning now to FIG. 4D, the liner ring slot 470 is positioned in the liner ring portion 454 at a junction of the liner ring portion 454 and the liner curved portion 456. The liner ring slot 470 is configured to facilitate the liner 430 breaking out cleanly from the bottom retention ring 406. The liner ring slot 470 has a generally trapezoidal cross section with a top dimension, D6, a height corresponding to a difference between the liner ring portion 454 thickness, T1, and a remaining thickness, D7, and slot side angles θ1, θ2. The liner ring slot 470 may thus provide a breaking feature for the liner 430.

Turning again to FIG. 4A, the EFP 404 is configured to form a slug that impacts a target. Slug formation is related to liner 430 geometry and thus liner geometric parameters. Liner geometric parameters may include, but are not limited to, outer radius, R1, inner radius, R2, the liner ring slot 470 dimensions and/or liner ring slot 470 position in the liner ring portion 454. In an embodiment, the outer radius, R1, and/or inner radius, R2, may be adjusted resulting in more or less curvature of each surface of the liner curved portion 456. For example, the position of outer radius center C1 and/or inner radius center C2, i.e., distance CD1 and/or CD2, may be adjusted, to adjust the outer radius R1 and/or the inner radius R2. In another example, adjusting the outer radius, R1, relative to the inner radius, R2, or the inner radius, R2, relative to the outer radius, R1, may increase or decrease a maximum liner (i.e., crescent) thickness, T3.

For example, simulation software may be utilized to identify values (or ranges of values) for the liner geometric parameters that may achieve an optimum slug formation at a target. The values may be identified based, at least in part, on an offset between the explosive system and the target, as described herein. CTH Shock Physics, developed at Sandia National Laboratories is one example of such simulation software. CTH is a multi-material, Eulerian, large deformation, strong shock wave, solid mechanics software system. CTH may be used to model multidimensional, multi-material, large deformation, strong shock wave physics. For example, CTH includes models for multi-phase, elastic, viscoplastic, porous and explosive materials.

Thus, one or more liner geometric parameters may be "tuned" to achieve a desired slug formation at the target.

In one nonlimiting example, referring to FIGS. 4A through 4D, D1 may be 25 mm (corresponding to a substrate body diameter of 25 mm) and D2 may be 50 mm. H1 may be 11 mm and H2 may be 49 mm. The outer radius, R1, may be 50.00 mm, the inner radius, R2, may be 39.50 mm, CD1 may be 43.20 mm and CD2 may be 29.20 mm. D2' may be 50.185 mm, D3 may be 50.349 mm, D4 may be 55.50±0.05 mm, D5 may be 2.00±0.01 mm, D6 may be 0.50 mm and D7 may be 0.70±0.01 mm. T1 may be 1.30 mm and T2 may be 10.287 mm. Angles θ1 and θ2 may each be 30 degrees.

Thus, in one example EFP, e.g., EFP 404, the corresponding explosive region may have a diameter of 25 mm at the top end and a diameter of 50 mm away from the top end. In other examples, the diameters of the explosive region may be larger or smaller and one or more dimensions related to the crescent liner geometric parameters may likewise be larger or smaller. For example, the diameters of the explosive region may be selected based, at least in part, on a diameter of an APIC body configured to couple to the EFP. Continuing with this example, the diameters of the explosive charge and/or liner geometric parameters may be related to a particular application of the corresponding explosive system. In other examples, depending on each application, dimensional tolerances may be relaxed or may be relatively precise, with the precision defined by the application.

Thus, an explosively formed projectile may be coupled to an off-axis APIC assembly and a continuous bore aperture may traverse the explosive system 400, providing an unobstructed path for a laser light beam through the explosive system 400.

Figure 5:
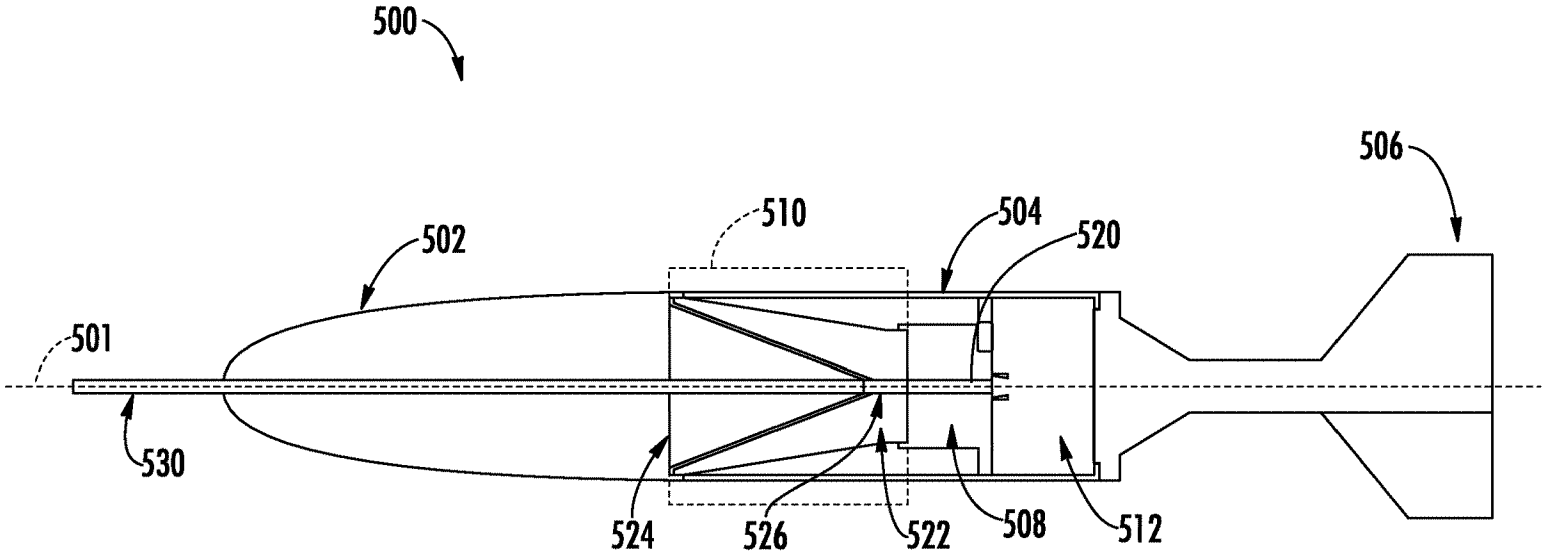
FIG. 5 illustrates one example munitions system that includes an off-axis APIC and an explosive charge, consistent with several embodiments of the present disclosure.

FIG. 5 illustrates one example munitions system 500 that includes an off-axis APIC assembly 508 and an explosive charge 510, consistent with several embodiments of the present disclosure. The munitions system 500 further includes a nose cone 502, a munition body 504 and a tail fin section 506. In this example, the explosive charge 510 corresponds to a shaped charge, as described herein. The off-axis APIC assembly 508 and the shaped charge 510 are contained in the munition body 504. The shaped charge 510 includes an explosive material region 522 and a shaped charge liner 524, as described herein.

The APIC assembly 508 includes a clear sight bore aperture 520 and the shaped charge 510 includes a corresponding shaped charge aperture 526. The clear sight bore aperture 520 and the shaped charge aperture 526 are aligned with a longitudinal center axis 501 of the munitions system 500. Thus, the clear sight bore aperture 520 and the shaped charge aperture 526 provide a continuous bore aperture through the off-axis APIC assembly 508 and explosive charge 510.

The munition body 504 further contains a notional smart fuse 512. The APIC assembly 508 is coupled between the shaped charge 510 and the smart fuse 512. In one embodiment, the smart fuse 512 may be configured to provide a laser beam 530. In this embodiment, the nose cone 502 is configured to be transparent to laser light. The laser beam 530 is configured to traverse the clear sight bore aperture 520, the shaped charge aperture 526 and the nose cone 502 and to exit the nose cone 502. For example, the laser beam 530 may be configured to illuminate a target for the munition system 500.

In another embodiment, the clear sight bore aperture 520 and shaped charge aperture 526 may be configured to carry electrical wiring, communication links, connections, etc., from the smart fuse 512 to circuitry that may be included in the nose cone 502.

In these embodiments (i.e., munitions systems), the standoff between the shaped charge 526 and the target may be, for example, five to six charge diameters. The five to six charge diameters are configured to allow an explosive jet to form. The explosive jet may be used, for example, for armor piercing. Thus, in these embodiments, secondary effects, as described herein, may be beneficial.

Thus, an off-axis APIC assembly may be configured to provide a ring light to a main explosive charge. The ring light may be triggered by an off-axis detonator. The off-axis APIC assembly may then include a continuous clear sight bore aperture configured to allow a beam, for example, of laser light to traverse the APIC assembly, unobstructed.

The off-axis APIC assembly may be coupled to a main explosive charge, e.g., a shaped charge or an EFP, in an explosive system. Characteristics of the main explosive charges may be "tuned" by adjusting selected dimensions (e.g., geometric parameters) of the main explosive charges. For example, a flare angle of a shaped charge may be adjusted to reduce N.E.W. and/or to reduce secondary effects for an explosive tool position, for example, 12 to 18 charge diameters from a target. In another example, radii of a liner of an EFP may be adjusted to optimize slug formation at a target. Liner ring slot features, e.g., slot location in the liner ring and/or slot size, may be adjusted to facilitate a clean break away of the liner.

The main explosive charge may include an explosive bore aperture configured to align with the APIC assembly clear sight bore aperture. Thus, the explosive system may be placed between a laser source and a target and the laser light may pass through a continuous bore aperture to illuminate the target. The laser beam may then be used to aim the explosive system. Thus, the explosive system, e.g., explosive tool, may be aimed and the laser source may be removed without touching the explosive tool and possibly disturbing the aim of the explosive tool. The explosive system may be placed twelve to eighteen charge diameters from the target, thus, enhancing the safety of an explosive ordnance technician.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents.

Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications.

What is claimed is:

1. An apparatus comprising:

a substrate body comprising a top end, an opposing bottom end and a curved outer surface positioned there between;

a clear sight bore aperture centered at a longitudinal axis of the substrate body;

a trunk line extending along the substrate body, the trunk line having a first end positioned at a top end of the substrate body, off-center from the longitudinal axis, the first end of the trunk line configured to couple to a detonator;

a plurality of helical tracks extending along the substrate body, a respective first end of each helical track coupled to the trunk line; and a plurality of terminations adjacent the bottom end of the substrate body, one termination coupled to the trunk line at a second end of the trunk line, the second end opposing the first end and each remaining termination coupled to a respective helical track, the trunk line, the plurality of helical tracks and the plurality of terminations containing an explosive material.

2. The apparatus of claim 1, further comprising a plurality of channel apertures defined in the outer surface of the substrate body, each channel aperture positioned adjacent at least one helical track.

3. The apparatus of claim 1, further comprising an end cap, a tamper and an explosive booster, the end cap configured to couple to the substrate body, the end cap defining an end cap aperture configured to align with the clear sight bore aperture when the end cap is coupled to the substrate body, the end cap further defining a detonator aperture configured to receive the detonator, the detonator configured to couple to a first end of the trunk line when the end cap is coupled to the substrate body, the tamper configured to contain an explosive initiation charge within the tamper between the end cap and a main explosive charge, and the explosive booster configured to couple to the plurality of terminations and to the substrate body at the bottom end of the substrate body.

4. The apparatus of claim 1, wherein each termination has a semicircular shape bounded by a curved portion and a termination bottom surface and a number of terminations is between six and thirty.

5. The apparatus of claim 1, wherein a target range of travel times for a plurality of paths between a trunk line first end positioned at the top end of the substrate body and a plurality termination bottom surfaces for a plurality of explosive wave fronts is less than 200 nanoseconds.

6. An explosive system comprising:

a main explosive charge; and an off-axis annular precision initiation charge (APIC) assembly coupled to the main explosive charge, the off-axis APIC assembly comprising:

a substrate body comprising a top end, an opposing bottom end and a curved outer surface positioned there between, a clear sight bore aperture centered at a longitudinal axis of the substrate body, a trunk line having a first end positioned at the top end of the substrate body, off-center from the longitudinal axis, the first end of the trunk line configured to couple to a detonator, a plurality of helical tracks, a respective first end of each helical track coupled to the trunk line, and a plurality of terminations positioned adjacent the bottom end of the substrate body, one termination coupled to the trunk line at a second end of the trunk line, the second end opposing the first end and each remaining termination coupled to a respective helical track, an explosive booster coupled to the plurality of terminations and to the substrate body at the bottom end of the substrate body, the trunk line, the plurality of helical tracks and the plurality of terminations containing an explosive material.

7. The system of claim 6, wherein the off-axis APIC assembly further comprises a plurality of channel apertures defined in the outer surface of the substrate body, each channel aperture positioned adjacent at least one helical track.

8. The system of claim 6, wherein the explosive booster extends from the outer surface of the substrate body to one half a radius of a top end of the main explosive charge.

9. The system of claim 6, wherein the main explosive charge comprises an explosive region and a liner, the explosive region defining an explosive bore aperture and the liner defining a liner aperture, the explosive aperture and liner aperture aligned with the clear sight bore aperture.

10. The system of claim 6, wherein the main explosive charge is a shaped charge comprising a conical liner and a shaped charge explosive region positioned on an outer surface of the conical liner, the conical liner defining a cone angle and the shaped charge explosive region has a flare angle measured between the outer surface of the conical liner and an outer surface of the shaped charge explosive region.

11. The system of claim 10, wherein the flare angle is in the range of zero to one half of the cone angle.

12. The system of claim 11, wherein a net explosive weight (N.E.W.) of the shaped charge is related to the flare angle.

13. The system of claim 10, further comprising a liner ring coupled to the conical liner at a bottom end of the conical liner and the bottom end of the conical liner corresponds to a charge diameter.

14. The system of claim 13, wherein the shaped charge is configured to be positioned twelve to eighteen charge diameters from a target.

15. The system of claim 6, wherein the main explosive charge is an explosively formed projectile (EPF) comprising a crescent liner and an EFP explosive region, the crescent liner positioned at a bottom end of the EFP.

16. The system of claim 15, wherein the EFP explosive region comprises a first explosive portion positioned adjacent a bottom end of the off-axis APIC assembly and a second explosive portion positioned between the first explosive portion and the crescent liner, a diameter of the second explosive portion greater than or equal to a diameter of the first explosive portion, the diameter of the first explosive portion corresponding to a diameter of the substrate body.

17. The system of claim 15, wherein the crescent liner comprises a liner curved portion and a liner ring portion, the liner curved portion having a crescent shaped cross section.

18. The system of claim 17, wherein the crescent liner comprises a liner ring slot.

19. The system of claim 17, wherein the EFP is configured to form a slug that impacts a target, the slug formation related to a liner geometric parameter, the liner geometric parameter selected from the group comprising a crescent liner outer surface outer radius (R1), a crescent liner inner surface inner radius (R2), a liner ring slot dimension and a liner ring slot position in the liner ring portion.

* * * * *